US009144894B2

(12) United States Patent
Barnett et al.

(10) Patent No.: US 9,144,894 B2
(45) Date of Patent: Sep. 29, 2015

(54) DRILL PIPE BREAKOUT MACHINE

(71) Applicant: Target Drilling, Inc., Smithton, PA (US)

(72) Inventors: Ryan Barnett, Grant Town, WV (US); Brody Conklin, Sycamore, PA (US)

(73) Assignee: TARGET DRILLING, INC., Smithton, PA (US)

( * ) Notice: Subject to any disclaimer, the term of this patent is extended or adjusted under 35 U.S.C. 154(b) by 271 days.

(21) Appl. No.: 13/672,098

(22) Filed: Nov. 8, 2012

(65) Prior Publication Data

US 2013/0118315 A1 May 16, 2013

Related U.S. Application Data

(60) Provisional application No. 61/558,633, filed on Nov. 11, 2011.

(51) Int. Cl.
*B25B 17/00* (2006.01)
*E21B 19/16* (2006.01)

(52) U.S. Cl.
CPC ..... *B25B 17/00* (2013.01); *E21B 19/164* (2013.01); *Y10T 29/49826* (2015.01)

(58) Field of Classification Search
CPC ..... B25B 13/5008; B25B 13/5016; B25B 13/505; B25B 13/5075; B25B 17/00; E21B 19/16; E21B 19/161; E21B 19/163; E21B 19/164; E21B 19/167
USPC ..... 81/57.15, 57.16, 57.18, 57.19, 57.2, 81/57.21
See application file for complete search history.

(56) References Cited

U.S. PATENT DOCUMENTS

| | | | | | |
|---|---|---|---|---|---|
| 2,000,221 | A * | 5/1935 | Dawson | ..... | 81/57.16 |
| 4,023,449 | A | 5/1977 | Boyadjieff | | |
| 4,246,809 | A * | 1/1981 | Keast et al. | ..... | 81/57.16 |
| 4,326,435 | A * | 4/1982 | Guillot et al. | ..... | 81/57.16 |
| 4,348,920 | A | 9/1982 | Boyadjieff | | |
| RE31,699 | E * | 10/1984 | Eckel | ..... | 81/57.18 |
| 4,765,401 | A | 8/1988 | Boyadjieff | | |
| 6,318,214 | B1 | 11/2001 | Buck | | |
| 6,752,044 | B2 * | 6/2004 | Hawkins, III | ..... | 81/57.16 |
| 6,776,070 | B1 | 8/2004 | Mason et al. | | |
| 7,249,639 | B2 | 7/2007 | Belik | | |
| 7,313,986 | B2 | 1/2008 | West et al. | | |
| 8,601,910 | B2 * | 12/2013 | Begnaud | ..... | 81/57.16 |
| 2006/0027047 | A1 * | 2/2006 | Buck | ..... | 81/57.18 |
| 2009/0211405 | A1 * | 8/2009 | Hunter et al. | ..... | 81/57.16 |

* cited by examiner

*Primary Examiner* — Hadi Shakeri
(74) *Attorney, Agent, or Firm* — The Webb Law Firm

(57) ABSTRACT

An apparatus includes: a first clamping mechanism having a first hollow portion that includes a first gripping die portion disposed therein and a second hollow portion that includes a second gripping die portion disposed therein such that a first well drilling component is positioned therebetween; a wedge-shaped plate positioned above the first clamping mechanism and including a first end having a notch formed therein and a second arcuate end having gear teeth formed therein; a second clamping mechanism supported by the wedge-shaped plate and including a first hollow portion having a first gripping die portion disposed therein and a second hollow portion having a second gripping die portion disposed therein such that a second well drilling component is positioned therebetween; and a drive mechanism. Operation of the drive mechanism rotates the wedge-shaped plate and the second clamping mechanism through about a 90° range of motion.

10 Claims, 9 Drawing Sheets

DRILL PIPE BREAKOUT MACHINE

CROSS REFERENCE TO RELATED APPLICATIONS

This application claims the benefit of U.S. Patent Application No. 61/558,633 entitled "Drill Pipe Breakout Machine" filed Nov. 11, 2011, which is hereby incorporated by reference in its entirety.

BACKGROUND OF THE INVENTION

1. Field of the Invention

The present disclosure is generally directed to an apparatus for connecting and disconnecting tubular members and, more particularly, to an apparatus for connecting and disconnecting well drilling components.

2. Description of Related Art

In the oil and gas industry, a drill string is used by a drilling rig to drill a well bore. The drill string is typically composed of drill pipe and a bottom hole assembly. The bottom hole assembly typically includes a drill bit, drill collars, and other drilling related tools. An automated apparatus, commonly known as an "Iron Roughneck", may be utilized to makeup (i.e., connect) and breakout (i.e., disconnect) threaded joints of drill pipe in a drill string. Iron Roughnecks have been used in the drilling industry for several years and are commercially available from a number of suppliers.

An Iron Roughneck generally comprises a two-piece wrench unit that provides the torque necessary to makeup or breakout the connection between two well drilling components. The bottom wrench, which serves as a backup wrench, grasps the tool joint of the drill pipe suspended in the rotary table or mousehole. The upper wrench grasps the tool joint of the pipe suspended from the derrick and applies either the final makeup or the initial breakout torque to the connection.

Various deficiencies exist in these prior art Iron Roughneck devices. First, the upper wrench of current Iron Roughneck designs can only rotate approximately 30°. This limitation in swing on the conventional Iron Roughnecks often necessitates two or more "bites" on the portions of the well drilling component to break the connection. In addition, the upper wrench and the bottom wrench each include a pair of faces having dies positioned thereon for gripping the well drilling component. During use of the Iron Roughneck, these dies wear and eventually need to be replaced. Current Iron Roughneck designs involve removing bolts that secure the dies or driving the dies out of dovetail slots in the clamp with a hammer in order to remove and replace the dies. Such removal processes run the risk of dropping the dies downhole.

Accordingly, a need exists for an apparatus for connecting and disconnecting well drilling components that includes an upper clamping mechanism capable of rotating 90° around the axis of the well drilling component. In addition, a need exists for an apparatus for connecting and disconnecting well drilling components that includes dies for gripping the well drilling component that can be easily and quickly removed and replaced.

SUMMARY OF THE INVENTION

An object of the present invention is to provide an apparatus for connecting and disconnecting well drilling components that includes an upper clamping mechanism capable of rotating 90° around the axis of the well drilling component. A further object of the present invention is to provide an apparatus for connecting and disconnecting well drilling components that includes dies for gripping the well drilling component that can be easily and quickly removed and replaced.

Accordingly, provided is an apparatus for connecting and disconnecting well drilling components that includes: a first clamping mechanism having a first hollow portion that includes a first gripping die portion disposed therein and a second hollow portion that includes a second gripping die portion disposed therein such that a first well drilling component is positioned between the first gripping die portion and the second gripping die portion; a wedge-shaped plate positioned above the first clamping mechanism and including a first end having a notch formed therein and a second arcuate end having gear teeth formed therein; a second clamping mechanism supported by the wedge-shaped plate and including a first hollow portion having a first gripping die portion disposed therein and a second hollow portion having a second gripping die portion disposed therein such that a second well drilling component is positioned between the first gripping die portion and the second gripping die portion; and a drive mechanism operably coupled to the gear teeth of the wedge-shaped plate. Operation of the drive mechanism rotates the wedge-shaped plate and the second clamping mechanism through about a 90° range of motion around an axis of the first and second well drilling components.

The first gripping die portion and the second gripping die portion of the first clamping mechanism may each include a support section having a front face with a slot formed therein and a die portion provided in the slot. The support section may be removably disposed within one of the first hollow portion and the second hollow portion of the first clamping mechanism. The support section may be coupled to one of the first hollow portion and the second hollow portion by a removable pin. The slot may have a dovetail cross-sectional shape.

The first gripping die portion and the second gripping die portion of the second clamping mechanism may also each include a support section having a front face with a slot formed therein and a die portion provided in the slot. The support section may be removably disposed within one of the first hollow portion and the second hollow portion of the second clamping mechanism. The support section may be coupled to one of the first hollow portion and the second hollow portion by a removable pin. The slot may have a dovetail cross-sectional shape.

A hydraulic cylinder may be provided to provide a force to engage the first gripping die portion and the second gripping die portion of the first clamping mechanism with the first well drilling component, and a force to engage the first gripping die portion and the second gripping die portion of the second clamping mechanism with the second well drilling component.

Also provided is an apparatus for connecting and disconnecting well drilling components that includes: a stationary clamping mechanism including a first hollow portion having a first gripping die portion disposed therein and a second hollow portion having a second gripping die portion disposed therein such that a first well drilling component is positioned between the first hollow portion and the second hollow portion; and a rotating clamping mechanism positioned above the stationary clamping mechanism and including a first hollow portion having a first gripping die portion disposed therein and a second hollow portion having a second gripping die portion disposed therein such that a second well drilling component is positioned between the first face and the second face. Each of the first gripping die portions and the second gripping die portions include a support section having a front face with a slot formed therein and a die portion provided in the slot. The support sections are removably disposed within one of the first hollow portion and the second hollow portion.

The apparatus may further include a wedge-shaped plate positioned between the stationary clamping mechanism and the rotating clamping mechanism with the rotating mechanism supported thereon. The wedge-shaped plate has a first end with a notch formed therein and a second arcuate end with gear teeth formed therein. The apparatus may also include a drive mechanism operably coupled to the gear teeth of the wedge-shaped plate. Operation of the drive mechanism may rotate the wedge-shaped plate and the rotating clamping mechanism through about a 90° range of motion around an axis of the first and second well drilling components.

The support sections may be coupled to one of the first hollow portion and the second hollow portion by a removable pin. Each slot may have a dovetail cross-sectional shape. A hydraulic cylinder may be provided to provide a force to engage the first steering die portion and the second gripping die portion of the stationary clamping mechanism with the first well drilling component, and the first gripping die portion and the second gripping die portion of the second clamping mechanism with a second well drilling component.

In addition, provided is a method of connecting and disconnecting well drilling components. The method begins by providing an apparatus that includes: a first clamping mechanism that includes a first hollow portion having a first gripping die portion disposed therein and a second hollow portion having a second gripping die portion disposed therein; a wedge-shaped plate positioned above the first clamping mechanism and including a first end having a notch formed therein and a second arcuate end having gear teeth formed therein; a second clamping mechanism supported by the wedge-shaped plate and including a first hollow portion having a first gripping die portion disposed therein and a second hollow portion having a second gripping die portion disposed therein; and a drive mechanism operably coupled to the gear teeth of the wedge-shaped plate. The method also includes: positioning a first well drilling component between the first gripping die portion and the second gripping die portion of the first clamping mechanism; positioning a second well drilling component between the first gripping die portion and the second gripping die portion of the second clamping mechanism; and operating the drive mechanism to rotate the wedge-shaped plate and the second clamping mechanism through about a 90° range of motion in a first direction to disconnect the first well drilling component and the second well drilling component if the first well drilling component and the second well drilling component are connected and operating the drive mechanism to rotate the wedge-shaped plate and the second clamping mechanism through about a 90° range of motion in a second direction to connect the first well drilling component and the second well drilling component if the first well drilling component and the second well drilling component are disconnected.

A hydraulic cylinder may be provided to provide a force to engage the first gripping die portion and the second gripping die portion of the first clamping mechanism with the first well drilling component, and a force to engage the first gripping die portion and the second gripping die portion of the second clamping mechanism with the second well drilling component. Each of the first gripping die portions and the second gripping die portions may include a support section having a front face with a slot formed therein and a die portion provided in the slot. The support sections may be removably disposed within one of the first hollow portion and the second hollow portion.

These and other features and characteristics of the present invention, as well as the methods of operation and functions of the related elements of structures, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE PREFERRED EMBODIMENT

Figure 1:
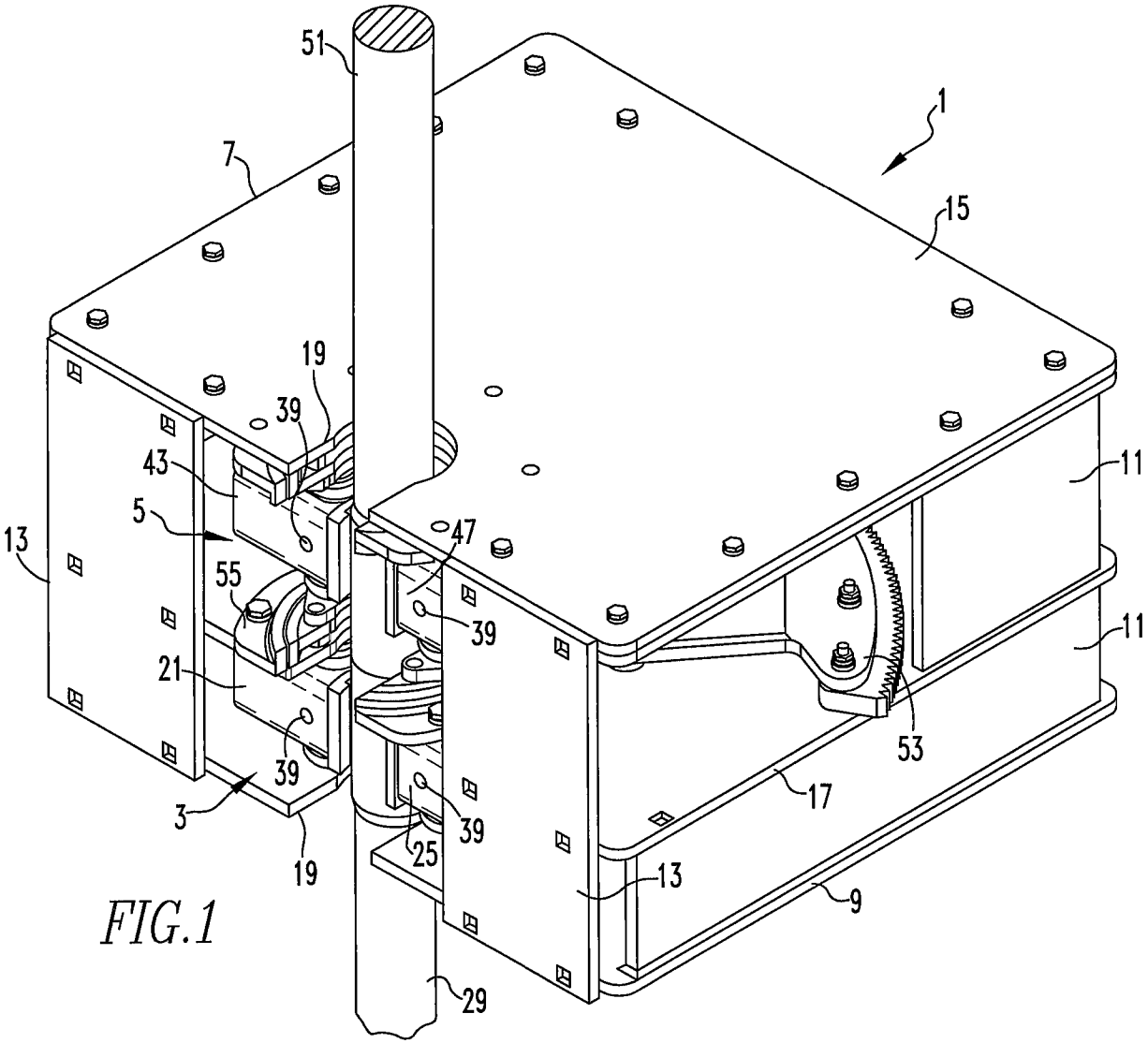
FIG. 1 is a perspective view of an apparatus for connecting and disconnecting well drilling components with a pair of well drilling components positioned therein in accordance with the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification are simply exemplary embodiments of the invention. Hence, specific dimensions and other physical characteristics related to the embodiments disclosed herein are not to be considered as limiting.

With reference to FIGS. 1-8, an apparatus for connecting and disconnecting well drilling components, denoted generally as reference numeral 1, such as an Iron Roughneck, includes a first or stationary clamping mechanism, denoted generally as reference numeral 3, and a second or rotating clamping mechanism, denoted generally as reference numeral 5, positioned within a housing 7. The housing 7 is comprised of a plurality of plates including but not limited to a bottom plate 9 for supporting the stationary clamping mechanism 3, a plurality of side plates 11, a pair of front plates 13 forming an opening therebetween, a top plate 15, at least one rear plate (not shown), and an intermediate plate 17 positioned between the top plate 15 and the bottom plate 9 for supporting the rotating clamping mechanism 5. The bottom plate 9, top plate 15, and intermediate plate 17 each include a notch 19 formed therein. When the housing 7 is assembled, each of the notches 19 is aligned (see FIG. 5). The notches 19 are configured to receive a well drilling component therein.

Figure 2:
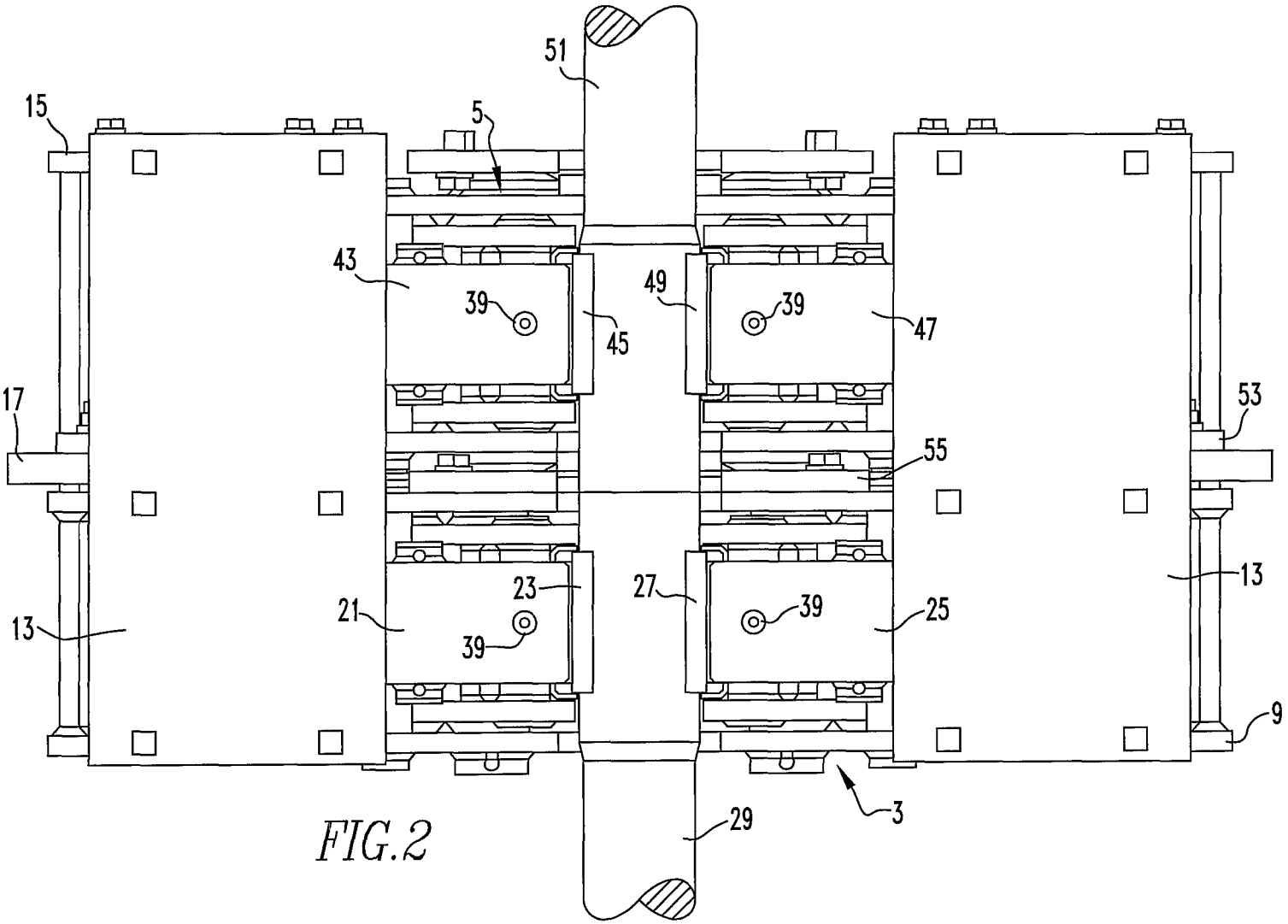
FIG. 2 is a front plan view of the apparatus of FIG. 1.
Figure 3:
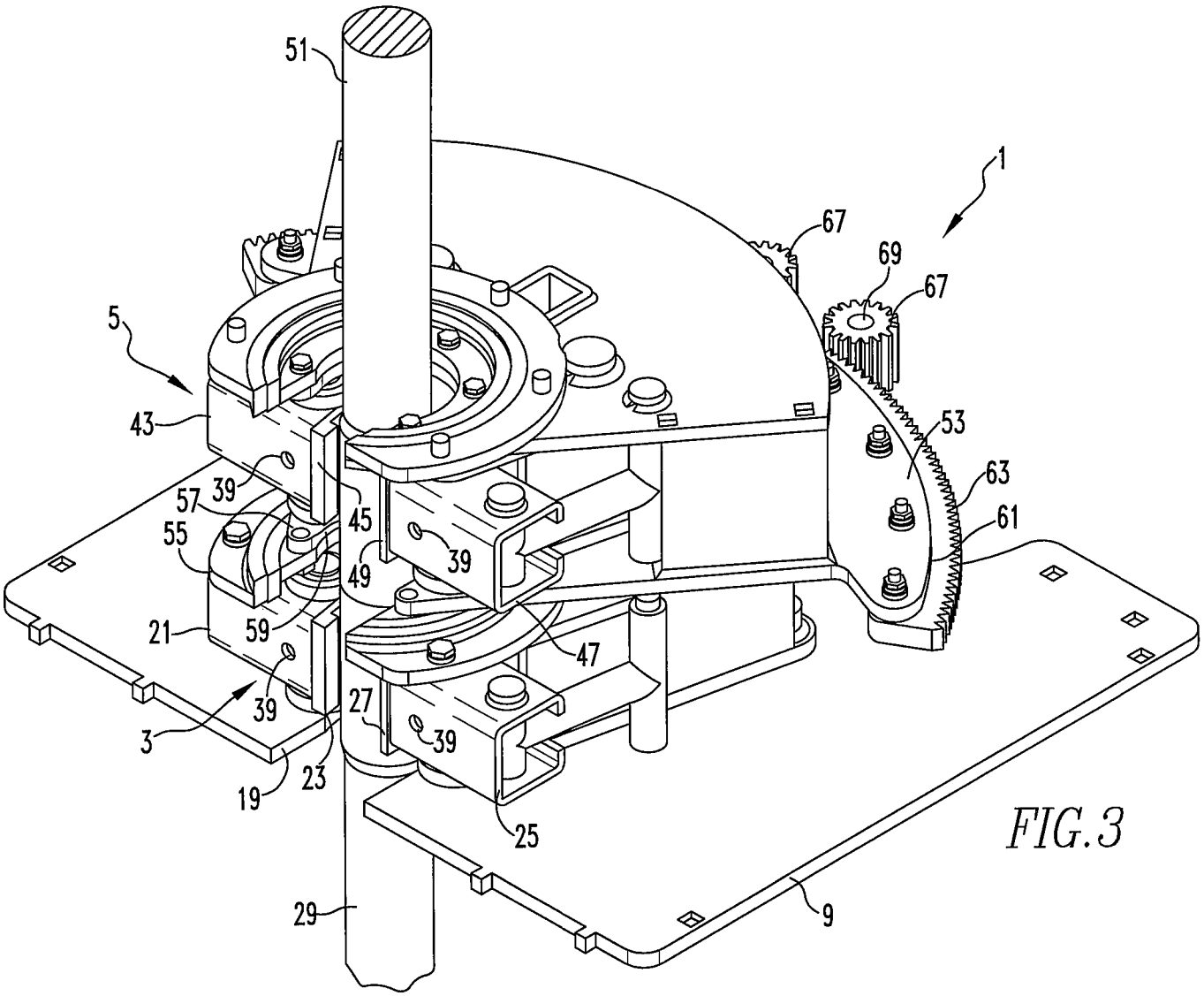
FIG. 3 is a perspective view of the apparatus of FIG. 1 with a portion of the housing removed.
Figure 4:
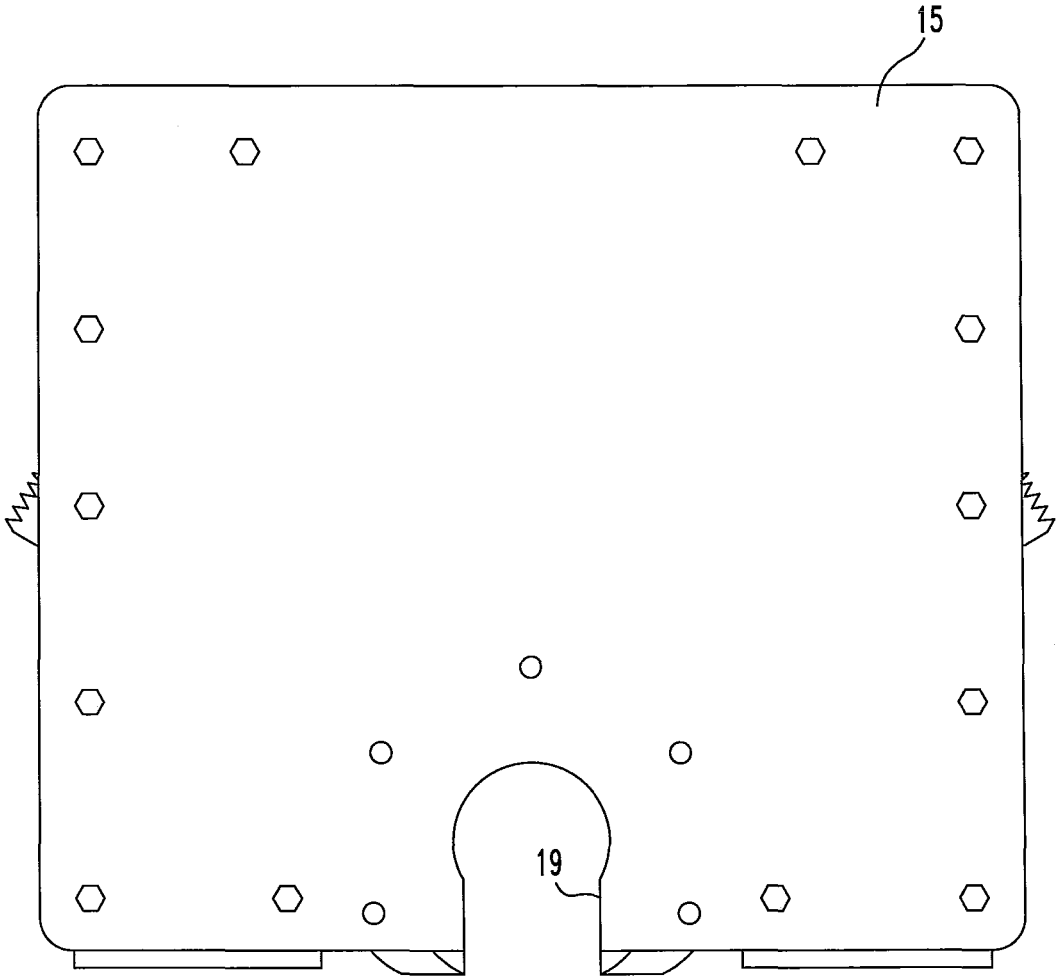
FIG. 4 is a top plan view of the apparatus of FIG. 1 without a pair of well drilling components positioned therein.
Figure 5:
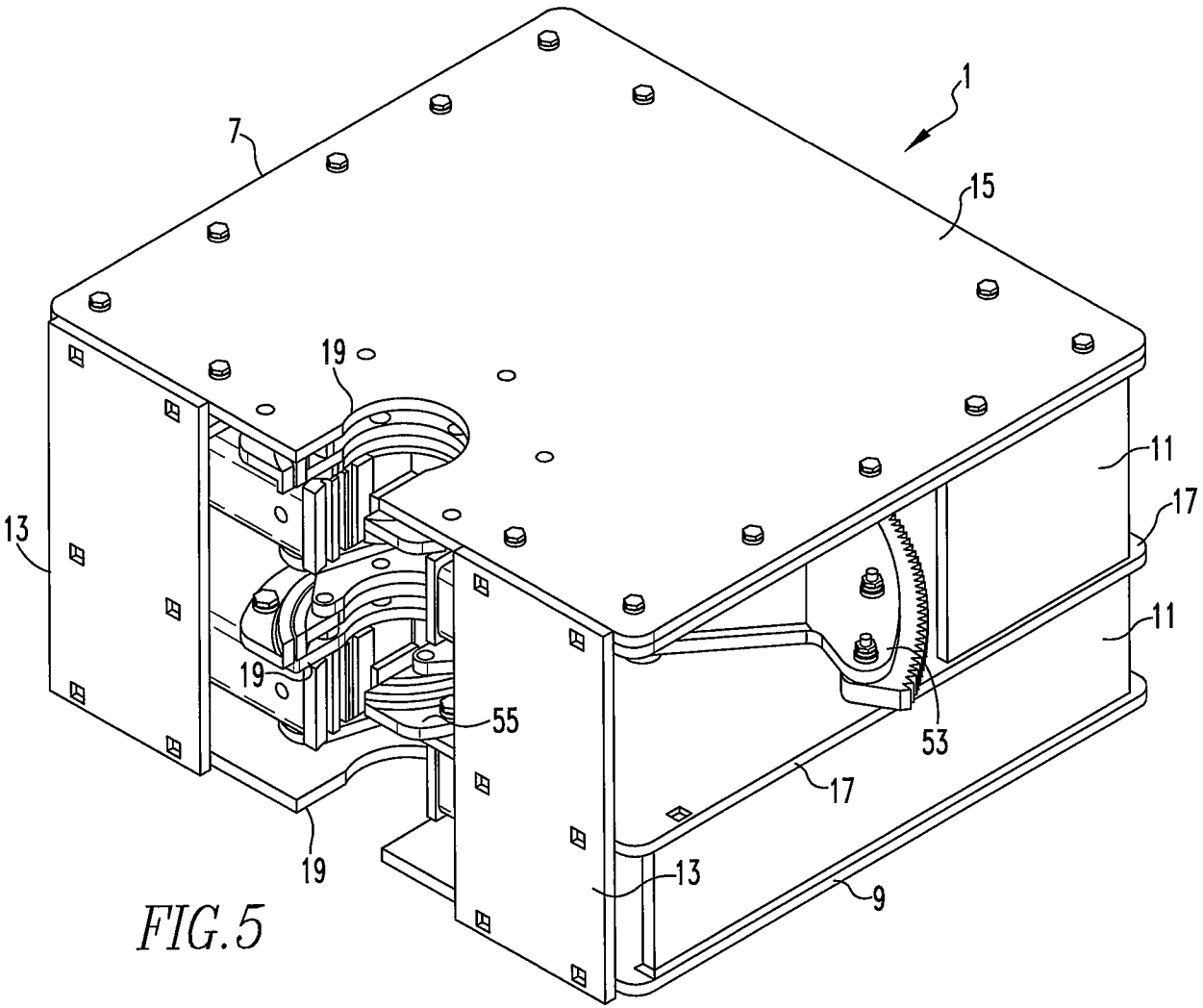
FIG. 5 is a perspective view of the apparatus of FIG. 4.
Figure 6:
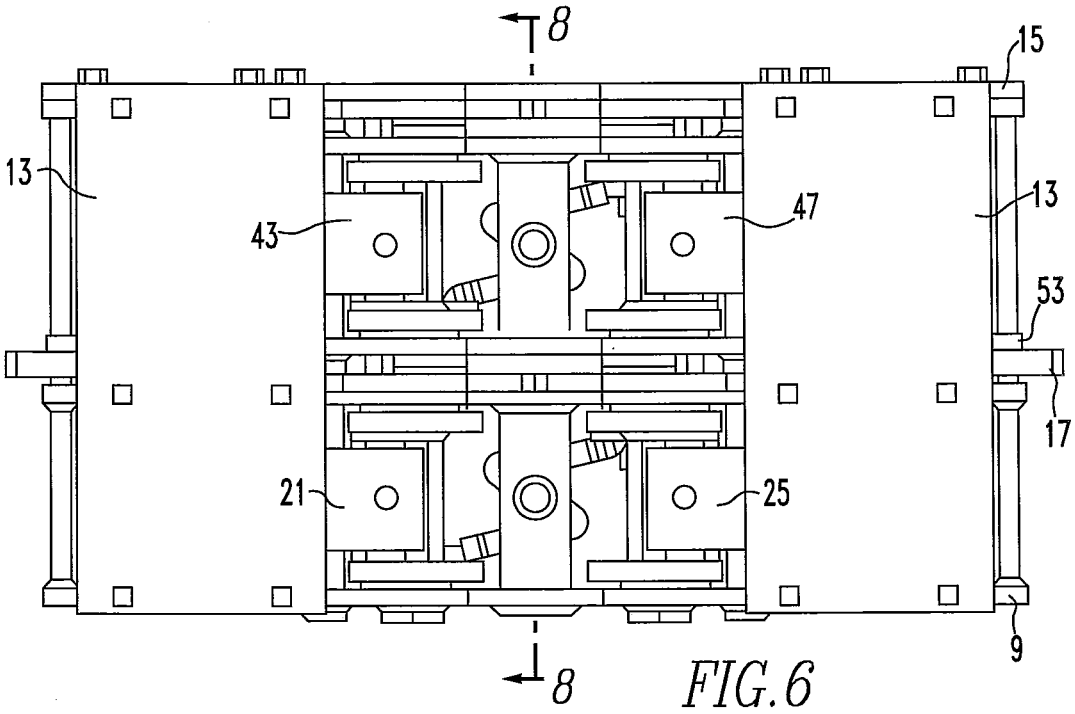
FIG. 6 is a front plan view of the apparatus of FIG. 4.
Figure 7:
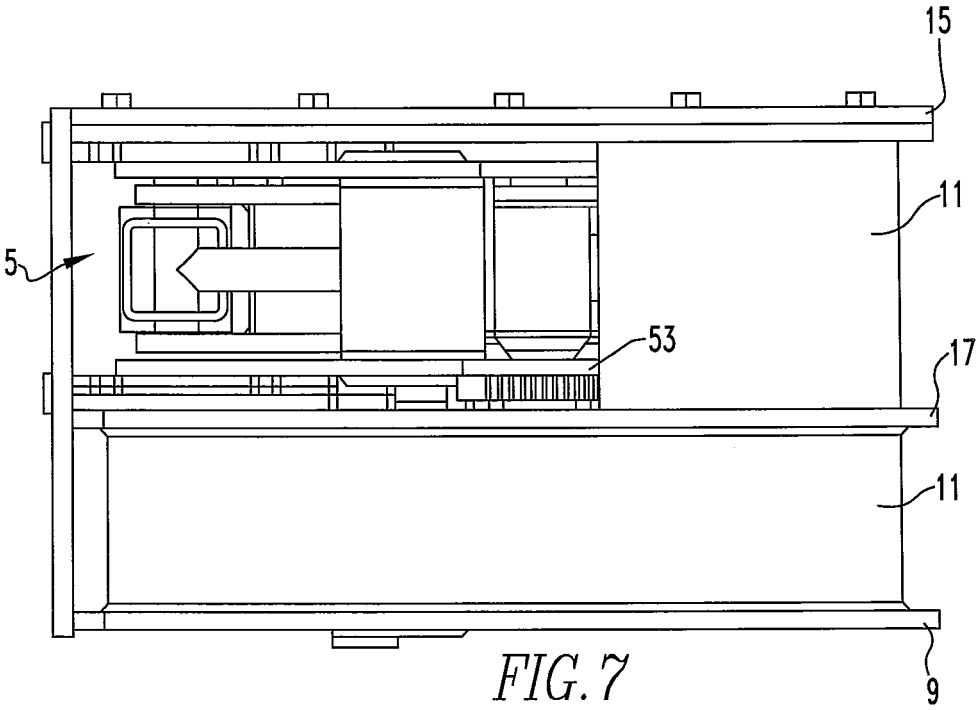
FIG. 7 is a side plan view of the apparatus of FIG. 4.
Figure 8:
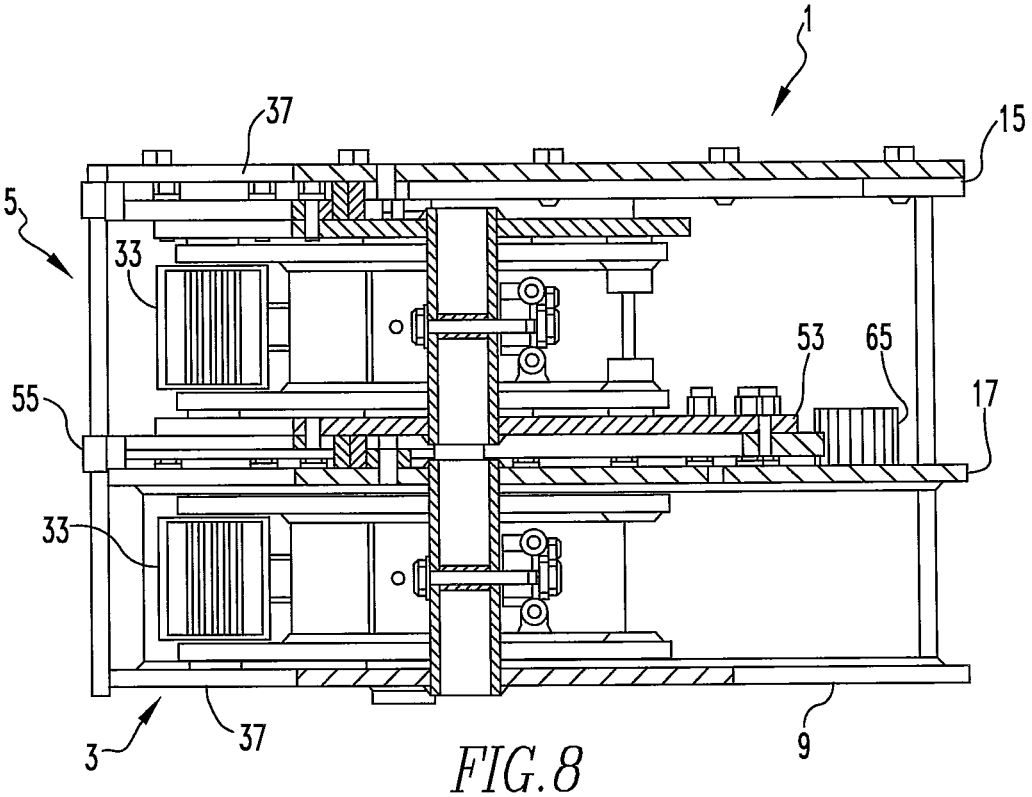
FIG. 8 is a cross-sectional view of the apparatus of FIG. 6 taken along line 8-8.

The stationary clamping mechanism 3 includes a first hollow portion 21 that includes a first gripping die portion 23 disposed therein and a second hollow portion 25 that includes a second gripping die portion 27 disposed therein such that a first well drilling component 29 is positioned between the first gripping die portion 23 and the second gripping die portion 27 (see FIGS. 1-3). A hydraulic cylinder (not shown) is provided to provide a force to move the first gripping die portion 23 and the second gripping die portion 27 toward and away from each other for gripping and releasing the first well drilling component 29.

The rotating clamping mechanism 5 is positioned above the stationary clamping mechanism 3 and includes a first hollow portion 43 having a first gripping die portion 45 disposed therein and a second hollow portion 47 having a second gripping die portion 49 disposed therein such that a second well drilling component 51 is positioned between the first gripping die portion 45 and the second gripping die portion 49 (see FIGS. 1-3). A hydraulic cylinder (not shown) is provided to provide a force to move the first gripping die portion 45 and the second gripping die portion 49 toward and away from each other for gripping or releasing the second well drilling component 51.

Figure 9:
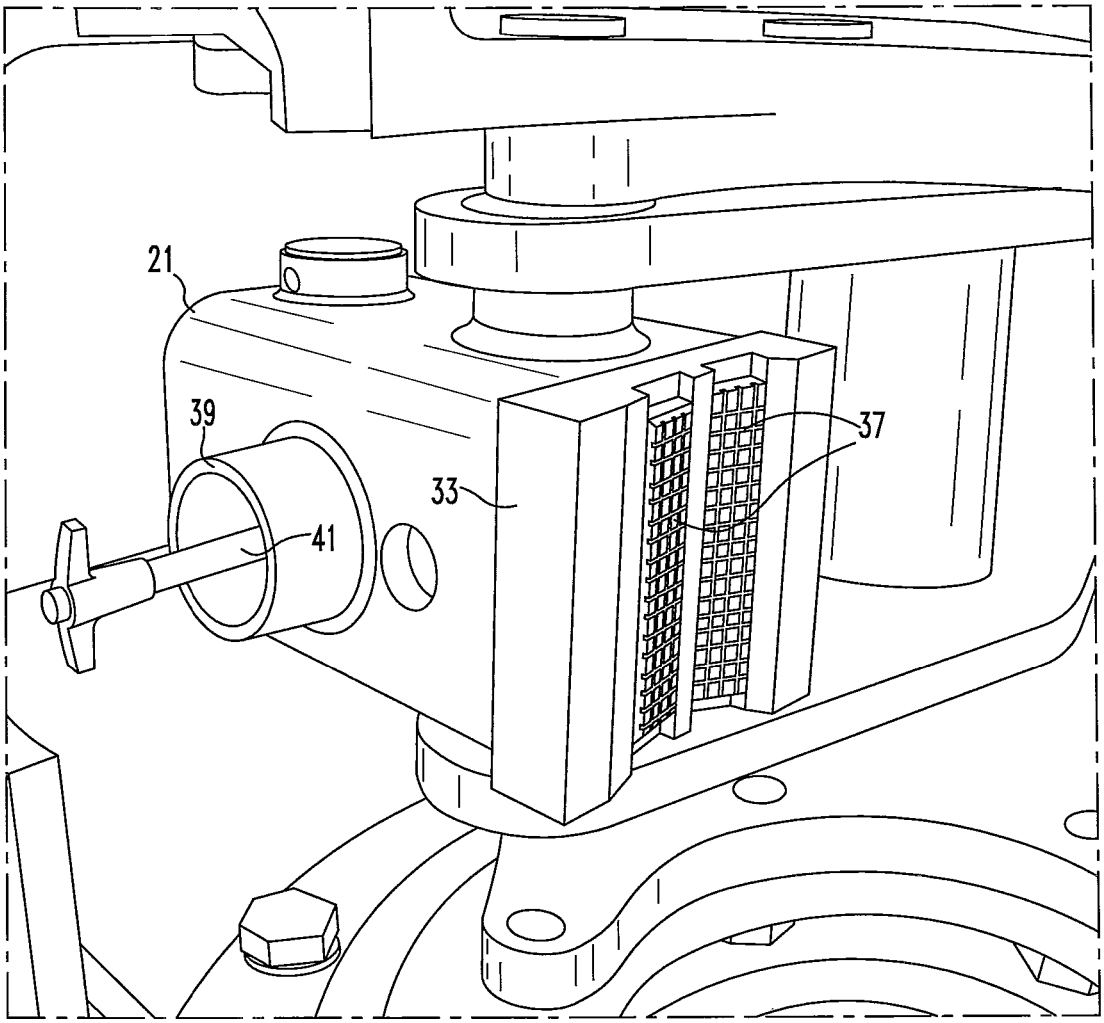
FIGS. 9 and 10 are photographs of a gripping die portion of the apparatus for connecting and disconnecting well drilling components in accordance with the present invention.
Figure 10:
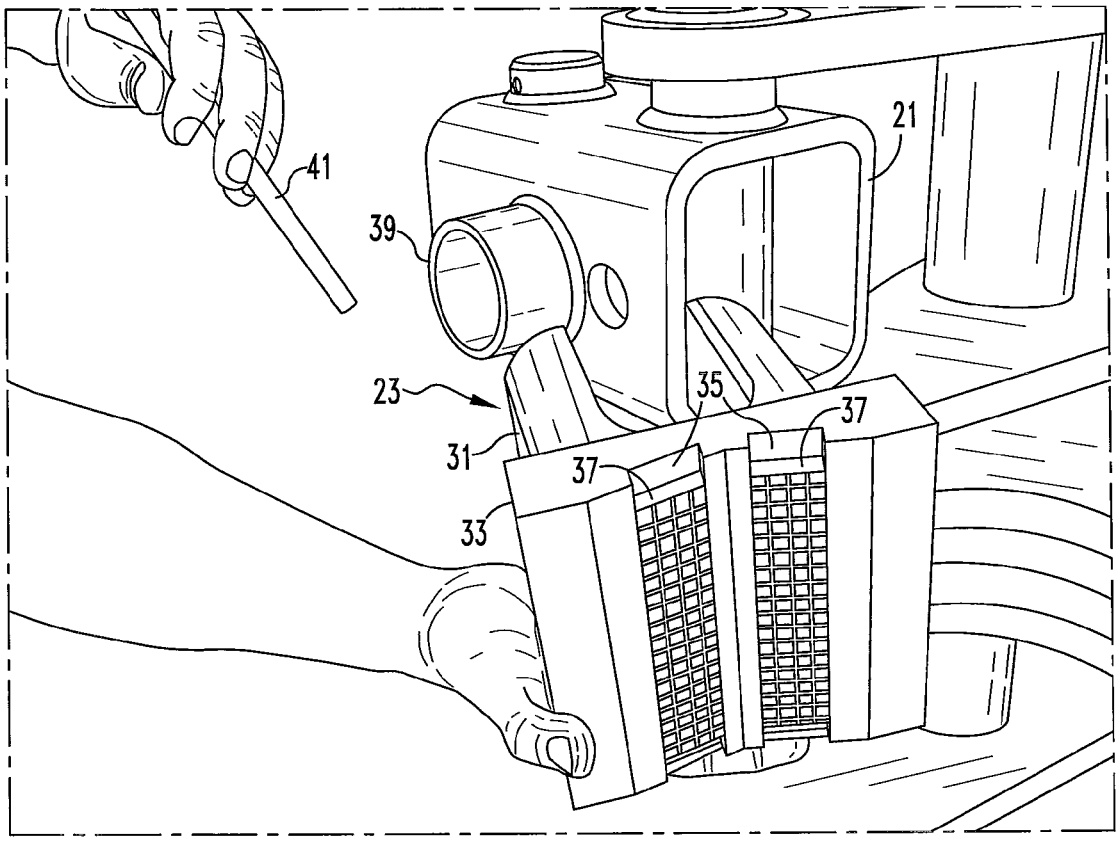

With reference to FIGS. 9 and 10, the first gripping die portion 23, 45 and the second gripping die portion 27, 49 of the stationary clamping mechanism 3 and the rotating clamping mechanism 5 each include a support section 31 having a front face 33 with at least one slot 35 (two are shown in the figures) formed therein and at least one die portion 37 provided in the slot 35. The support sections 31 are configured to be removably disposed within the first hollow portion 21 and the second hollow portion 25 of the stationary clamping mechanism 3 and within the first hollow portion 43 and the second hollow portion 47 of the rotating clamping mechanism 5. Each support section 31 includes a generally square cross-sectional shape that corresponds to the cross-sectional shape of the hollow portions 21, 25, 43, 47, thereby allowing the support sections 31 to be slid into and out of the hollow portions 21, 25, 43, 47. The support sections 31 are secured to the hollow portions 21, 25, 43, 47 by a removable pin 41 that passes through holes 39 provided in the hollow portions 21, 25 and holes provided in the support sections 31. Accordingly, when a user determines that the die portion 37 has been worn and needs to be replaced, the user can easily and quickly remove and replace the die portion 37 by removing the pin 41, pulling the support section 31 out of the hollow portion 21, 25, 43, or 47, and replacing the support section 31 with a new support section 31 that has a new die portion 37.

The die portions 37 are manufactured from a hardened steel and have a roughened front surface that comes in contact with the well drilling component such that the die portions 37 grip the well drilling component. In addition, the die portions 37 are configured to have a dovetail cross-sectional shape that corresponds to the cross-sectional shape of the slot 35 such that a dovetail connection is established therebetween. However, this is not to be construed as limiting the present invention as any suitable cross-sectional shape may be utilized.

The apparatus 1 also includes a wedge-shaped plate 53 positioned above the stationary clamping mechanism 3 and supported by the intermediate plate 17 of the housing 7 on a pair of wear plates 55. The rotating clamping mechanism 5 is supported on the wedge-shaped plate 53. The wedge-shaped plate 53 includes a first end 57 having a notch 59 formed therein and a second arcuate end 61 having gear teeth 63 formed therein. The notch 19 is configured to receive a well drilling component therein. A drive mechanism is also provided to drive the wedge-shaped plate 53 such that it rotates 90° around the axis of a well drilling component positioned within the apparatus 1. The drive mechanism may be embodied as a pair of hydraulic swing motors 65 having gears 67 driven by drive shafts 69. The gears 67 of the hydraulic swing motors 65 are operably coupled to the gear teeth 63 of the wedge-shaped plate 53, thereby allowing the hydraulic swing motors 65 to drive the wedge-shaped plate 53 and the rotating clamping mechanism 5 through its range of motion.

As discussed hereinabove, the apparatus 1 is configured to connect and disconnect well drilling components as the well drilling components are inserted into or removed from a well. With reference to FIGS. 1 and 2, the well drilling components 29 and 51 are illustrated as being drill pipes and the following description describes a process for connecting and disconnecting two drill pipes. However, this is not to be construed as limiting the apparatus 1 disclosed herein as it can also be used to connect and disconnect many other drilling components including, but not limited to, blowout preventers, drill collars, drill collars with spiral grooves, stabilizers, drill bits, and bottom hole assemblies including drill bits.

In operation, the apparatus 1 is positioned over the centerline of a well. The stationary clamping mechanism 3 and the rotating clamping mechanism 5 are then aligned and the gripping die portions 23, 27, 45, 49 are retracted (i.e., move away from each other) by the hydraulic cylinders. With the clamping mechanisms 3, 5 aligned and the gripping die portions 23, 27, 45, 49 retracted, the two well drilling components 29, 51 (e.g., two pieces of drill pipe threadedly connected together) can be received within the apparatus 1. Thereafter, the rotating clamping mechanism 5 is rotated 45° to the right of a person looking at the front of the apparatus 1 and the gripping die portions 23, 27, 45, 49 of both the stationary and rotating clamping mechanisms are moved by their respective hydraulic cylinders to clamp the first drilling component 29 and the second drilling component 51. Next, the hydraulic swing motors 65 are operated to rotate the wedge-shaped plate 53 and the second clamping mechanism 5 through about a 90° range of motion around an axis of the first and second well drilling components 29, 51, thereby disconnecting the second well drilling component 51 from the first well drilling component 29.

In order to connect two well drilling components, a similar procedure is followed as discussed hereinafter. First, the apparatus 1 is positioned over the centerline of a well. The stationary clamping mechanism 3 and the rotating clamping mechanism 5 are then aligned and the gripping die portions 23, 27, 45, 49 are retracted (i.e., move away from each other) by the hydraulic cylinders. With the clamping mechanisms 3, 5 aligned and the gripping die portions 23, 27, 45, 49 retracted, a first well drilling component 29 is received between the gripping die portions 23, 27 of the stationary clamping mechanism 3. The second well drilling component 51 is then aligned with the first well drilling component 29 and positioned between the gripping die portions 45, 49 of the rotating clamping mechanism 5. Thereafter, the rotating clamping mechanism 5 is rotated 45° to the left of a person looking at the front of the apparatus 1 and the gripping die portions 23, 27, 45, 49 of both the stationary and rotating clamping mechanisms are moved by their respective hydraulic cylinders to clamp the first drilling component 29 and the second drilling component 51. Next, the hydraulic swing motors 65 are operated to rotate the wedge-shaped plate 53 and the second clamping mechanism 5 through about a 90° range of motion around an axis of the first and second well drilling components 29, 51, thereby connecting the second well drilling component 51 to the first well drilling component 29.

The components of the apparatus 1 may be controlled by an operator at the rig. Alternatively, a wireless or wired remote controller may be provided for controlling the apparatus 1 from a remote location.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An apparatus for connecting and disconnecting well drilling components, the apparatus comprising:

a first clamping mechanism comprising a first hollow portion having a first gripping die portion disposed therein and a second hollow portion having a second gripping die portion disposed therein such that a first well drilling component is positioned between the first gripping die portion and the second gripping die portion;

a wedge-shaped plate positioned above the first clamping mechanism and comprising a first end having a notch formed therein and a second arcuate end having gear teeth formed therein;

a second clamping mechanism supported by the wedge-shaped plate and comprising a first hollow portion having a first gripping die portion disposed therein and a second hollow portion having a second gripping die portion disposed therein such that a second well drilling component is positioned between the first gripping die portion and the second gripping die portion; and a drive mechanism operably coupled to the gear teeth of the wedge-shaped plate, wherein operation of the drive mechanism rotates the wedge-shaped plate and the second clamping mechanism through about a 90° range of motion in one direction around an axis of the first and second well drilling components, wherein the first gripping die portion and the second gripping die portion of the first clamping mechanism each comprise a support section having a front face with a slot formed therein and a die portion provided in the slot, wherein the support section is removably disposed within one of the first hollow portion and the second hollow portion of the first clamping mechanism, wherein the support section is coupled to one of the first hollow portion and the second hollow portion by a removable pin, and wherein the slot has a dovetail cross-sectional shape.

2. The apparatus of claim 1, wherein the first gripping die portion and the second gripping die portion of the second clamping mechanism each comprise a support section having a front face with a slot formed therein and a die portion provided in the slot.

3. The apparatus of claim 2, wherein the support section is removably disposed within one of the first hollow portion and the second hollow portion of the second clamping mechanism.

4. The apparatus of claim 3, wherein the support section is coupled to one of the first hollow portion and the second hollow portion by a removable pin.

5. The apparatus of claim 2, wherein the slot has a dovetail cross-sectional shape.

6. The apparatus of claim 1, wherein a force is provided to engage the first gripping die portion and the second gripping die portion of the first clamping mechanism with the first well drilling component, and a force is provided to engage the first gripping die portion and the second gripping die portion of the second clamping mechanism with the second well drilling component.

7. A method of connecting and disconnecting well drilling components, the method comprising:

providing an apparatus comprising:

a first clamping mechanism comprising a first hollow portion having a first gripping die portion disposed therein and a second hollow portion having a second gripping die portion disposed therein;

wherein the first gripping die portion and the second gripping die portion of the first clamping mechanism each comprise a support section having a front face with a slot formed therein and a die portion provided in the slot, wherein the support section is removably disposed within one of the first hollow portion and the second hollow portion of the first clamping mechanism, wherein the support section is coupled to one of the first hollow portion and the second hollow portion by a removable pin, and wherein the slot has a dovetail cross-sectional shape;

a wedge-shaped plate positioned above the first clamping mechanism and comprising a first end having a notch formed therein and a second arcuate end having gear teeth formed therein;

a second clamping mechanism supported by the wedge-shaped plate and comprising a first hollow portion having a first gripping die portion disposed therein and a second hollow portion having a second gripping die portion disposed therein; and a drive mechanism operably coupled to the gear teeth of the wedge-shaped plate;

positioning a first well drilling component between the first gripping die portion and the second gripping die portion;

positioning a second well drilling component between the first gripping die portion and the second gripping die portion; and operating the drive mechanism to rotate the wedge-shaped plate and the second clamping mechanism through about a 90° range of motion in a first direction to disconnect the first well drilling component and the second well drilling component if the first well drilling component and the second well drilling component are connected and operating the drive mechanism to rotate the wedge-shaped plate and the second clamping mechanism through a 90° range of motion in a second direction to connect the first well drilling component and the second well drilling component if the first well drilling component and the second well drilling component are disconnected.

8. The method of claim 7, wherein a force is provided to engage the first gripping die portion and the second gripping die portion of the first clamping mechanism with the first well drilling component, and a force is provided to engage the first gripping die portion and the second gripping die portion of the second clamping mechanism with the second well drilling component.

9. The method of claim 7, wherein each of the first gripping die portions and the second gripping die portions comprise a support section having a front face with a slot formed therein and a die portion provided in the slot.

10. The method of claim 9, wherein the support sections are removably disposed within one of the first hollow portion and the second hollow portion.

* * * * *